United States Patent [19]

Ogasa et al.

[11] 4,038,992

[45] Aug. 2, 1977

[54] GRANULAR COMPOSITION FOR TOBACCO FILTER

[75] Inventors: Katsuhiro Ogasa, Yokohama; Joji Ono, Chiba; Tsutomu Kudo; Kazuyoshi Doi, both of Kawasaki; Katsuichi Noguchi; Kazuo Maeda, both of Yokohama, all of Japan

[73] Assignees: The Japan Tobacco & Salt Public Corporation; Morinaga Milk Industry Co., Ltd., both of Tokyo, Japan

[21] Appl. No.: 617,582

[22] Filed: Sept. 29, 1975

[51] Int. Cl.[2] ..... A24B 15/02; A24B 15/033

[52] U.S. Cl. ..... 131/10.7; 131/207; 131/266

[58] Field of Search ..... 131/265, 266, 268, 143, 131/140 B, 10.7, 207, 11, 13, 3

[56] References Cited

U.S. PATENT DOCUMENTS

| | | | |
|---|---|---|---|
| 2,804,874 | 9/1957 | Visnick | 131/10.7 |
| 2,881,770 | 4/1959 | Touey | 131/266 |
| 2,917,054 | 12/1959 | Touey | 131/266 |
| 2,928,399 | 3/1960 | Touey | 131/266 |
| 3,234,948 | 5/1964 | Stebbings | 131/265 |
| 3,251,365 | 5/1966 | Keith | 131/265 |
| 3,390,687 | 7/1968 | Lynn | 131/266 |
| 3,547,009 | 12/1970 | Molins | 131/10.7 |
| 3,670,740 | 6/1972 | Takenaka et al. | 131/265 |

FOREIGN PATENT DOCUMENTS

| | | | |
|---|---|---|---|
| 1,083,502 | 1/1955 | France | 131/265 |
| 4,819,800 | 3/1973 | Japan | 131/208 |
| 4,993,600 | 9/1974 | Japan | 131/208 |
| 329,353 | 6/1958 | Switzerland | 131/265 |

*Primary Examiner*—Robert W. Michell
*Assistant Examiner*—T. S. Gron
*Attorney, Agent, or Firm*—Oblon, Fisher, Spivak, McClelland & Maier

[57] ABSTRACT

A granular composition having a grain size of 10 to 50 mesh and a bulk density of 0.5 to 0.7 g/cm³ suitable for use in a tobacco filter or a tobacco pipe and having the ability to selectively remove carcinogenic and deleterious components from tobacco smoke comprises granules which are composed of bovine milk whey protein power and/or egg white protein powder, and one or more excipients selected from the group consisting of powdered cellulose, wheat flour, starch, rice flour, sugar, glucose, lactose, talc, alumina, zeolite or silica gel; or composite granules which are a blend of said granules and charcoal granules.

6 Claims, 1 Drawing Figure

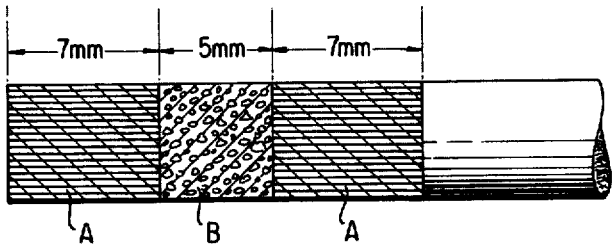
7mm
5mm
7mm
A
B
A

GRANULAR COMPOSITION FOR TOBACCO FILTER

BACKGROUND OF THE INVENTION

1. Field of the Invention

The present invention relates to a granular composition suitable for use in a tobacco filter or a tobacco pipe.

More particularly, the present invention relates to a granular composition capable of selectively and effectively removing the carcinogenic and deleterious components from tobacco smoke.

2. Description of the Prior Art:

Provision of devices for removing the carcinogenic components from tobacco smoke without concomitant deterioration in the taste of the smoke is an urgent social problem. In the past, cigarettes have been joined to cellulose or acetyl-cellulose filter tips or have had charcoal granule filters in attempting to solve this problem. The filters, which were described above, are known to remove tar, nicotine or other deleterious components in tobacco smoke by adsorption. However, proper evaluation of the effectiveness of a tobacco filter should be made by measuring the rate of adsorptive removal of 3,4-benzpyrene, volatile phenol and tar from tobacco smoke since the former two components are the most virulent carcinogen and co-carcinogen, respectively, in tobacco smoke and since tar causes smokers extensively unfavorable effects. A filter material which manifests dual affinity to both 3,4-benzpyrene, a non-polarized molecule, and phenol, a polarized molecule, has not yet been developed.

Previously, the present inventors had observed that bovine milk whey protein and egg white protein preferentially associate with carcinogenic hydrocarbons. A patent application (Japanese Patent Public Disclosure No. 19800/73 and No. 93600/74) was filed for a method for preparing a tobacco filter plug which enables selective removal of carcinogenic hydrocarbons comprising adhesion of bovine milk whey protein, egg white protein or a mixture of these two protein species in a powdered state to a fibrous filter in an amount of 3% of the weight of the fibrous substrate. The removal of carcinogenic hydrocarbons from tobacco smoke was effected by including these protein powders in a tobacco filter. However, this caused a pronounced pressure drop during smoking, since the fine protein powders, reduced the cavity space between the filter fibers and consequently impaired the harmony of the smoking taste.

Attempts were made to eliminate this unfavorable effect by employing a filter, containing granules prepared solely from the protein powders (hereinafter referred to as "the protein"). Efforts were devoted to prepare such granules on an industrial scale. This proved to be extremely difficult using conventional granulating devices because of the extraordinary stickiness of the protein when it was mixed with water or compressed for granule formation. Furthermore, the small amount of protein granules, which were prepared manually with much difficulty, exhibited an unexpectedly lower rate of removal of the deleterious components in tobacco smoke. The reason was that the granules prepared from genuine protein possessed smoother peripheral surfaces and the non-specific physical interaction between the granules and the smoke components was inhibited. In such a case, the removal of the smoke components by the genuine protein granules is only effected by specific chemical interaction with the protein.

SUMMARY OF THE INVENTION

Accordingly, it is an object of the present invention to provide a granular composition for use in tobacco filters or tobacco pipes which removes the carcinogenic and deleterious components in tobacco smoke and which refines the smoking taste, resulting in an achievement of safer, more pleasurable smoking.

It is another object of this invention to provide such a granular composition of protein powders which may be mechanically prepared using conventional granulating devices.

It is still another object of this invention to provide a granular composition which is capable of selectively removing a granular composition which is capable of selectively removing the carcinogenic and deleterious components in tobacco smoke when used in a tobacco filter, without causing any pressure drop or impairment of the smoking taste.

Briefly, these and other objects of this invention, as will hereinafter become clear from the ensuing discussion, have been attained by providing a granular composition comprising:

1. granules having a grain size of 10 to 50 mesh and a bulk density of 0.5 to 0.7 g/cm$^3$ which are composed of 5 to 70% by weight (hereinafter abbreviated as %) of commercially available protein powders of bovine milk whey and/or egg white, and 30 to 95% of one or more excipient materials selected from the group consisting of powdered cellulose, wheat flour, starch, rice flour, sugar, glucose, lactose, talc, alumina, zeolite and silica gel; or granules having a grain size of 10 to 50 mesh and a bulk density of 0.5 to 0.7 g/cm$^3$ which are formed by coating the above-described protein powders onto the periphery of the above-described excipient materials in a proportion of 5 - 70% of the protein powders to 30 - 95% of the excipient materials (hereinafter, either of these are referred to as "protein granules"); or 2. granules having a grain size of 10 to 50 mesh and a bulk density of 0.5 to 0.7 g/cm$^3$ which are a blend of the above-described protein granules, and charcoal granules having a grain size of 10 to 50 mesh and a bulk density of 0.5 to 0.7 g/cm$^3$ (hereinafter referred to as "composite granules"). It is preferred that the protein granules be present in from 40 to 80% and the charcoal granules from 20 to 60%.

BRIEF DESCRIPTION OF THE DRAWINGS

A more complete appreciation of the invention and many of the attendant advantages thereof will be readily attained as the same becomes better understood by reference to the following detailed description when considered in connection with the accompanying Drawings, wherein:

The FIGURE illustrates the structure of a triple filter used in this invention.

DETAILED DESCRIPTION OF THE PREFERRED EMBODIMENTS

1. Preparation of the protein granules and the composite granules.

Suitable protein powders to be employed for preparation of the compositions of the present invention include commercially available genuine bovine milk whey protein powder or genuine egg white protein powder which are not off-flavored or mixtures of them in unrestricted ratios. Suitable excipients to be employed in the compositions of the present invention include commercially available powdered cellulose, wheat flour, starch, rice flour, sugar, glucose, lactose, talc, alumina, zeolite, silica gel, and mixtures thereof, all of which are genuine and free from off-flavoring. Similarly, the charcoal granules to be employed in the compositions of the present invention include those which are commercially available and are free from off-flavoring.

The protein powder and the excipient are mixed in a proportion of 5 - 70% of the former to 30 - 95% of the latter. Water, an aqueous solution of ethanol or glycerol having a concentration lower than 20%, or an aqueous solution of ethylene glycol having a concentration lower than 5% is added. The mixture is then subjected to granule formation by means of a conventional extruding or spinning mill which is equipped with apertures of 0.8 to 2.0 mm in diameter. The granules are then dried at 70° C to achieve a moisture lower than 10%. Those granules falling within the size range of 10 to 50 mesh are gathered by means of a sieve. The protein granules thus obtained, having a bulk density of 0.5 to 0.7 g/cm$^3$, can be used as a tobacco filter or in a tobacco pipe.

The protein granules may be prepared by coating the protein onto the periphery of the excipient granules having a grain size of 20 to 60 mesh which have been previously formed. Protein granules prepared by means of this coating procedure and having the size and bulk density described above can be used in the present invention.

The resultant protein granules can then be blended with charcoal granules having a grain size of 10 to 50 mesh and a bulk density of 0.5 to 0.7 g/cm$^3$ in a ratio of from 40 to 80% of the former to from 20 to 60% of the latter granules in order to obtain a composite granule. The composite granules thus obtained, having a grain size of 10 to 50 mesh and a bulk density of 0.5 to 0.7 g/cm$^3$ display a superior effect in removing the deleterious components from tobacco smoke as compared to the protein granules.

Having generally described the invention, a more complete understanding can be obtained by reference to certain specific Experiments and Examples, which are provided herein for purposes of illustration only and are not intended to be limiting unless otherwise specified.

EXPERIMENT 1

Traits of the protein granule.

Evidence of the removal of the deleterious components from cigarette smoke by the protein granules and compositions. Protein granules, in which the contents of bovine milk whey protein were adjusted to 3, 5, 20, 50, 70 and 90%, and in which the excipient granules were prepared solely from corn starch, were prepared according to the procedure for preparation of the protein granules for blending with charcoal granules as described in Example 3, except that the bovine milk whey protein was prepared by isolation from skimmed milk by adjustment of the pH to 4.6 followed by centrifuging to discard the casein precipitate, dialysing the supernatant fraction and spray drying. The preparation of protein granules, in which the protein content is elevated to 70% and 90%, was found to be difficult since water addition caused extreme stickiness of the material. Therefore, preparation was achieved manually by employing an aqueous solution of 30 to 50% ethanol in place of water.

One hundred mg of the above-described protein granules and excipient granules, was placed in the central layer of a conventional triple filter for a cigarette as illustrated in FIG. 1, where A and B respectively stand for acetylcellulose and the protein granules and the numerals indicate the lengths of the layers in mm.

The triple filter was prepared by a double-wheeled complex filter machine equipped with a granule inserter. The filament and total deniers of acetylcellulose in this triple filter were 4 and 43,000, respectively. The filters were numbered in accordance with their protein contents, as indicated in Table 1.

TABLE 1

| Filter numbers | Protein content in % (corn starch excipient only) (acetylcellulose monolayer) |
|---|---|
| 1 | |
| 2 | 0 |
| 3 | 3 |
| 4 | 5 |
| 5 | 20 |
| 6 | 40 |
| 7 | 70 |
| 8 | 90 |

Samples of cigarette "H", marketed in Japan, were joined to each of the triple filters above and were subjected to mechanically simulated smoking tests at a smoke flow rate of 17.5 ml/second, a puffing period of 2/second, a smoking frequency of 1/minute and a butt length of 50 mm.

The smoke condensate was collected on a Cambridge filter CM-113 of 44 mm in diameter. Determination of the tar, volatile phenol and 3,4-benzpyrene contents on the Cambridge filter were made by subtracting the water content which was assayed by the Karl-Fischer procedure (K. Fischer, Zeitschrift fur angewandte Chemic, 48,394, 1935) from the weight of the smoke condensate determined by means of 4-aminoantipyrine reagent (Y. Kaburagi, et al, Scientific Papers of the Central Research Institute, Japan Tobacco and Salt Public Corporation, No. 107, 181, 1965), and by the procedure of Davis (H. J. Davis, et. al., Analytical Chemistry 38, 1752, 1966).

The rates of removal of the deleterious components from the smoke were determined by the following equation and are tabulated in Table 2.

$$\text{rate of removal} = \frac{A - B}{A} \times 100$$

A and B are, respectively, the quantity of the smoke components obtained from the cigarette which was not equipped with a filter, and the quantity obtained from cigarettes which were equipped with filters.

TABLE 2

| filter No. | bulk density (g/cm$^3$) | rate of removal (%) | | |
|---|---|---|---|---|
| | | 3.4BP* | vol. phenol** | tar |
| 1 | — | 9 | 65 | 38 |
| 2 | 0.34 | 15 | 34 | 34 |
| 3 | 0.34 | 19 | 42 | 36 |
| 4 | 0.37 | 41 | 67 | 39 |
| 5 | 0.42 | 42 | 70 | 42 |
| 6 | 0.62 | 42 | 71 | 41 |
| 7 | 0.74 | 41 | 66 | 39 |
| 8 | 0.76 | 41 | 62 | 32 |

*3,4-benzpyrene
**volatile phenol

It is evident that the capacity of the triple filter containing the protein granules to remove 3,4-benzpyrene is 5-fold higher than it is for the equivalent acetylcellulose monolayer filter. The rate of removal of volatile phenol was significantly elevated when the protein content in granules was higher than 5%. However, the rate of removal of tar was lowered when the protein content exceeded 70%. The protein content in the protein granule should, therefore, be higher than 5% but lower than 70% in order to achieve the satisfactory removal of all of these deleterious components from tobacco smoke.

Additionally, the above-mentioned cigarettes were joined to filters containing charcoal granules, or a mixture of charcoal granules and hydrated magnesium silicate granules. These conventional granules filters were subjected to experiments on the removal of tobacco smoke components in accordance with the procedure described above. They, respectively, removed 33 and 40% of tar, 51 and 54% of volatile phenol, and 32 and 24% of 3,4-benzpyrene from the cigarette smoke. On the other hand, the protein granules are capable of removing volatile phenol at a rate 1.4-fold higher than these conventional granules when placed in the triple filter. The capacity of 3,4-benzpyrene removal by the protein granules remarkably exceeded that of the conventional granules by a factor of from 1.4 to 1.8. The protein granules, therefore, possess the unique property that they exhibit a dual affinity to both the polar (phenol) and non-polar (3,4-benzpyrene) components in tobacco smoke, while acetylcellulose and charcoal preferentially associate with only one of these alternatives.

It may seem to be rather contradictory that a filter made of protein granules which is composed of genuine protein with a protein content of 90%, and possesses a smoother peripheral surface (as mentioned in the "Description of the Prior Art" section) has a lower rate of removal than does the filter having granules in which the protein is blended with an excipient. The explanation is that the protein granules which are prepared from a mixture of the protein and the excipient in a ratio within the above prescribed range, possesses a rather rough periphery. This causes both physical and chemical adsorption of the smoke components which, in turn, leads to a higher removal rate when it is incorporated in the filter.

EXPERIMENT 2

Size of the protein granules.

Protein granules were prepared by the procedure of Example 2, except that the granules were subjected to fractional sieving in order to collect the granules falling in size ranges of lower than 10, 10 to 30, 30 to 50, and higher than 50 mesh. One hundred mg of each of these categories of protein granules was placed in the triple filters as described in Experiment 1. The triple filters were joined to "H" cigarettes and the pressure drop was determined under the standard puffing conditions described in Experiment 1 in order to assess the significance of the size range of the protein granules (Table 3).

TABLE 3

| granule size | length of the central layer (mm) | pressure drop (mm $H_2O$) |
|---|---|---|
| < 10 mesh | 5.2 | 37 |
| 10 ~ 30 mesh | 5.2 | 46 |
| 30 ~ 50 mesh | 5.2 | 46 |
| > 50 mesh | 5.0 | 56 |
| *(acetylcellulose) | — | 45 |

*an acetylcellulose monolayer filter of 17 mm length

The conventional acetylcellulose filter, which is in conventional use by consumers at the present time, displayed a pressure drop of 45 mm$H_2O$. Therefore, the size of the protein granules should be 10 to 50 mesh to obtain similar drops.

EXPERIMENT 3

Bulk density of the granules

Protein granules of bulk density varying within the range of from 0.3 to 0.8 g/cm$^3$ were prepared according to the procedure for preparation of the protein granules to be blended with the charcoal granules as in Example 3, except that 20% ethanol was employed in place of water as the granulating agent in a quantity of from 20 to 200% of the mixture of the protein and the excipient. This resulted in production of granules having a bulk density falling in the range of from 0.3 to 0.8 g/cm$^3$. The protein granules were then blended with an equal quantity of charcoal granules having a grain size of 10 to 50 mesh, which have been employed for cigarette filters in the past and are commercially available. The mixtures were subjected to 200 taps in test tubes. Manifestation of a homogeneous single layer after tapping was employed as the criterion fo inspection. The ranges of bulk density of the protein granules which resulted in two separate layers were rejected. The protein granules of 0.5 to 0.7 g/cm$^3$ were observed to be compatible with the above criterion. Thus, the bulk density of the protein granules should be within this range.

EXPERIMENT 4

Traits of the composite granule

Evidence of removal of the deleterious components from cigarette smoke by the composite granules.

Triple filters were prepared in accordance with the procedure described in Experiment 1, and 8 numbered filters were provided according to the granular species which were placed in the central layer of the triple filters as indicated below.

| Filter No. | Granule in the triple filter |
|---|---|
| 1 | none (The central layer is empty.) |
| 2 | 100 mg of the composite granule (Example 1) |
| 3 | 100 mg of the composite granule (Example 3) |
| 4 | 100 mg of the protein granule (Example 1) |
| 5 | 100 mg of the protein granule (Example 3) |
| 6 | 100 mg of charcoal granule (10 to 50 mesh) |
| 7 | 50 mg of the protein granule (Example 1) |
| 8 | 50 mg of charcoal granule (10 to 50 mesh) |

The composite granules were prepared by the procedure described in Examples 1 and 3. The protein granules were those obtained previous to blending with the charcoal granules as described in Examples 1 and 3. The charcoal granules used in this experiment were identical to those described in Experiment 3.

The above-described triple filters were then joined to "H" cigarettes and were subjected to the mechanically simulated smoking test as described in Experiment 1. Determination of the amounts of tar, moisture and volatile phenol were made by the procedure described in Experiment 1. The total alkaloid content in the tar was assayed according to a procedure by Willits (Willits, C. O., et al Analytical Chemistry 22, 430, 1950). One ml of the gas phase from the 4th puff was subjected to gas chromatographic analysis for isoprene, acetaldehyde and acetone (Maeda, K. et al, Scientific Papers of the Central Research Institute, Japan Tobacco and Salt Public Corporation, No. 115, 33, 1973). The rate of removal was calculated from the equation described in Experiment 1, and is tabulated in Table 4.

TABLE 4

| Filter No. | | 1 | 2 | 3 | 4 | 5 | 6 | 7 | 8 |
|---|---|---|---|---|---|---|---|---|---|
| length of the central layer (mm) | | 0 | 5 | 5 | 5 | 5 | 5 | 2.5 | 2.5 |
| wt. of the protein granules (mg) | | 0 | 50 | 50 | 100 | 100 | 0 | 50 | 0 |
| wt. of the charcoal granules (mg) | | 0 | 50 | 50 | 0 | 0 | 100 | 0 | 50 |
| pressure drop ($mmH_2O$) | | 32 | 46 | 47 | 44 | 46 | 46 | 39 | 39 |
| removal (%) | tar | 28 | 40 | 42 | 36 | 36 | 36 | 33 | 31 |
| | alkaloids | 23 | 33 | 34 | 29 | 30 | 30 | 27 | 26 |
| | vol. phenol | 48 | 67 | 61 | 72 | 60 | 54 | 59 | 50 |
| | isoprene | 0 | 56 | 60 | 0 | 0 | 79 | 0 | 50 |
| | acetaldehyde | 0 | 52 | 49 | 0 | 0 | 75 | 0 | 48 |
| | acetone | 4 | 75 | 73 | 12 | 6 | 82 | 5 | 60 |

The amount of removal by the granules in the central layer is derived by subtracting the values for Filter No. 1 from those of Nos. 2 through 8. As can be seen from Table 4, the amounts of tar removed by 50 mg of the protein granule (no. 7) and by 50 mg of the charcoal granule (No. 8) were 5 (i.e., 33–28) and 3 (i.e., 31–28), respectively, whereas those for 100 mg of the composite granules (Nos. 2 and 3) were 12 (i.e., 40–28) and 14 (i.e., 42–28), respectively. These values are significantly higher than those obtained by summation of the amounts removed by the protein granules (No.7) and by the charcoal granules (No.8). Therefore, the amounts of tar removed by the composite granules are synergistically elevated to values higher than those obtained by merely adding the effects of the individual components. This synergism in the rate of removal by the composite granule is clearly also observed for alkaloids, isoprene and acetone. The rates of removal of the other constituents by 100 mg of the composite granules were also significantly higher than those by equivalent amounts of the constituting individual granules.

It is concluded that the composite granules of the present invention are capable of removing the deleterious components in cigarette smoke to a higher degree than what would be expected by mere addition of the removal values for the constituting individual granules or the conventional tobacco filter materials.

EXPERIMENT 5

Reduction of the cell toxicity of tobacco smoke by filtering through the composite granules.

The toxicity of tobacco smoke to the cultured mammalian cell line and its reduction by the triple filters with the composite granules were tested. The cells of a cultured cell line established from a mouse kidney, $C_3H2K$ (H. Yoshikura, et al, Experimental Cell Research, 48, 226, 1967) were proliferated in 2 ml of Eagle-MEM medium (H. Eagle, Science, 130, 432, 1959) with 1% calf serum which was placed in a Petri dish of 3 cm in diameter to form a cell density of $5 \times 10^5$ in the dish for 7 days at 37° C in a $CO_2$-incubator. The culture medium was discarded and the cell layer was raised by an isotonic salt solution (R. Dulbecco, et al, Journal of Experimental Medicine, 99, 167, 1954, hereinafter abbreviated by PBS−). Triple filters containing the granules of Nos. 2, 4, 5 and 6 of Experiment 4 and a conventional acetylcellulose monolayer filter were joined to "H" cigarettes. They were mounted onto a smoking machine, which had previously been irradiated with ultraviolet light in order to prevent bacterial contamination, and were subjected to simulated mechanical smoking in a germ-free chamber. The tobacco smoke from 10 cycles of smoking was introduced into 18 ml of a MEM medium containing 0.05% dimethylsulfoxide. Two ml of serum were added and 2 ml portions of the smoked medium were added to the cell layer obtained above. The cells were exposed to the smoked medium for 4 hours at 37° C. The medium was then discarded and the cells were rinsed with PBS− repeatedly. Two ml of the MEM-serum medium were added and the cells were incubated for 7 days at 37° C. The cell density was determined by means of microscopic cell nuclei counting on an hematocytometer. The relative cell density after incubation in the smoked medium was expressed as a percentage of the control cell density, determined by incubation of cells in a medium which was not exposed to the smoke. The results are tabulated in Table 5.

TABLE 5

| *Filter No. | exposure to smoke | relative cell density |
|---|---|---|
| 2 | not exposed | **(100) |
| filterless | exposed | 1.0 |
| acetylcellulose monolayer | " | 16.8 |
| 4 | " | 71.9 |
| 2 | " | 84.4 |
| 6 | " | 70.3 |

*The filter numbers are identical to those of Experiment 4.
**$1.28 \times 10^6$/dish The survival fraction of the cells after exposure to tobacco smoke emanating from the protein granules was higher than the case of an acetylcellulose monolayer by a factor of 4. The capability of the composite granule filter to lower the cell toxicity of tobacco smoke was higher by a factor of 5 and 1.2, respectively, relative to those of acetylcellulose and the charcoal. The composite granules of the present invention, therefore, are able to reduce the toxicity of the tobacco smoke to the organs of the smokers. Ability of the protein granules to reduce the cell toxicity of tobacco smoke was comparable to that of the charcoal granules in this biological experiment. This is due to the fact that the deleterious gas components in tobacco smoke are the dominant cause of cell lethality in this experimental system. This situation caused an apparent stimulation of the reduction of cell toxicity by the charcoal granules since it preferentially removes the gas component. However, it is evident that the significance of the protein granules in removing the carcinogens or co-carcinogens in tobacco smoke tar exceeds that of the charcoal granules from the results of the chemical analysis described in Experiment 1.

EXPERIMENT 6

The ratio between the protein and the charcoal granules in the composite granules.

Composite granules, in which the ratio of the protein granules (having a content of bovine milk whey protein of 5%) ranged from 10 to 90% in 10 or 20% increments as designated in Table 6, were prepared according to the procedure of Example 1. These composite granules, and the charcoal and the protein granules were subjected to the test for reduction of the cell toxicity of tobacco smoke by the procedure of Experiment 5. The relative cell density after incubation in the smoked medium was expressed as the percentage relative to the control cell density, obtained by incubation of cells in a medium which was not exposed to the smoking.

The results are tabulated in Table 6.

TABLE 6

| % of the protein granules | exposure to smoke | relative cell density |
|---|---|---|
| 0 | exposed | 70 |
| 10 | " | 72 |
| 20 | " | 71 |
| 40 | " | 80 |
| 60 | " | 86 |
| 80 | " | 85 |
| 90 | " | 76 |
| 100 | " | 72 |
| 100 | not exposed | *(100) |

*1.28 × 10⁶/dish

It is clear from the results of Table 6 that the cell toxicity of tobacco smoke was reduced when the smoke was filtered through the composite granules in which the protein granules were present in a proportion of 40 to 80%.

EXPERIMENT 7

Refinement of the smoke taste by the composite granules.

Triple filters identical to those of Nos. 3, 5 and 6 of Experiment 4, were respectively joined to "H" cigarettes and subjected to organoleptic tests on smoking taste by 18 panelists. The tests were performed twice and the flavor of the smoke was rated on the following basis: 1 (favorite), 2 (intermediate), and 3 (unfavorite). The score of the 3 filters are tabulated in Table 7.

TABLE 7

| Filter Nos. in Exp. 4 | | | Number of panelists used in this |
|---|---|---|---|
| No. 6 (A) | No. 5 (B) | No. 3 (C) | (D) |
| 1 | 3 | 2 | 5 |
| 2 | 3 | 1 | 16 |
| 3 | 1 | 2 | 9 |
| 3 | 2 | 1 | 6 |
| Score: 82 | 84 | 50 | (36) |

The score was calculated by vertical summation of the values

The score was calculated by vertical summation of the values A × D, B × D and C × D. The scores of the flavor for the charcoal and the protein granules (A and B) were comparable while the composite granules refined the smoking taste remarkably.

It is evident that the protein granules prepared from bovine milk whey protein and an excipient, display a pronounced effect in removal of deleterious components from tobacco smoke. It has also been confirmed that egg white protein, or a mixture of bovine milk whey protein and egg white protein, exhibit a comparable effect to bovine milk whey protein. Consequently, they also can be employed in the present invention.

The excipients employed for preparation of the protein granules in Experiments 1 7 were wheat flour and corn starch. The rates of removal of volatile phenol from tobacco smoke by other excipient granules and protein granules, have also been determined. The results are tabulated in Table 8. The procedure used for preparation of the excipient granules and the protein granules of 20% protein concentration, and for determination of the removal efficiency in this experiment were the same as the techniques described in Experiment 1.

TABLE 8

| excipient | granule | bovine milk whey | protein | egg white |
|---|---|---|---|---|
| cellulose | excipient | | 32 | |
| | protein | 65 | | 62 |
| rice flour | excipient | | 34 | |
| | protein | 66 | | 68 |
| sugar | excipient | | 33 | |
| | protein | 65 | | 60 |
| glucose | excipient | | 33 | |
| | protein | 68 | | 61 |
| lactose | excipient | | 38 | |
| | protein | 71 | | 70 |
| talc | excipient | | 32 | |
| | protein | 64 | | 61 |
| alumina | excipient | | 35 | |
| | protein | 66 | | 63 |
| zeolite | excipient | | 38 | |
| | protein | 69 | | 67 |
| silica gel | excipient | | 38 | |
| | protein | 67 | | 64 |

It was accordingly confirmed that protein granules, in which powdered cellulose, rice flour, sugar, glucose, lactose, talc, alumina, zeolite or silica gel were employed as the excipient constituent exhibited removal traits essentially the same as those indicated in Experiment 1.

EXAMPLE 1

Fifteen kg of wheat flour was mixed with 8.4 kg. of 20% ethanol by a screw mixer (Fuji Paudal Co., Japan) and the mixture was granulated by means of a spinning mill (Showa Engineering Co., Ltd., Japan) with apertures of 2 mm in diameter. The granules were then dried for 30 minutes at 60° C followed by gathering of the fraction having a grain size of 12 to 60 mesh with a standard sieve. Nine kg of the granules having a grain size of 12 to 60 mesh were sprayed with 500 g of tap water and gradually 910 g of bovine milk whey protein were added to it (New Zealand Dairy Board, "Edible Lactoalbumin", protein 53%, lactose 31%, ash 3%, fat 2%, moisture 2%) in a rotating granulator (Chikuko Seisakusho, Japan). The spherical granules thus obtained were finally dried for 24 hours at A60° C in order to obtain about 8.5 kg of protein granules having a grain size of 10 to 50 mesh, a moisture content of 7.5% and a bulk density of 0.65 g/cm³. Eight kg of the protein granules were blended with an equal quantity of charcoal granules having a grain size of 10 to 50 mesh and a bulk density of 0.53 g/cm³ with a V-shaped mixer to yield about 16 kg of composite granules having a grain size of 10 to 50 mesh and a bulk density of 0.59 g/cm³.

EXAMPLE 2

Ten kg of lactose (Coop Condensfabrik Friesland, "Edible Lactose", lactose 94%, ash 0.5%, moisture 5%) and 3 kg of bovine milk whey protein (Hollandish Melkesuikefabrik "Hi-protal", protein 51% lactose 41%, ash 2%, fat 3%, moisture 3%) were first mixed and then 2 kg of tap water was added during further mixing in a screw mixer. The mixture was extruded from apertures of 1.5 mm in diameter installed on an extruding pelleter (Nippon Yakugyo Co., Ltd., Japan). The mixture was then treated in the spinning mill which was described in Example 1. The granules thus obtained were then dried for 48 hours at 60° C followed by sifting in order to obtain about 10 kg of protein granules having a grain size of 12 to 50 mesh and a bulk density of 0.57 g/cm³.

EXAMPLE 3

One hundred kg of corn starch was added to 20 kg of bovine milk whey protein as described in Example 1, and the mixture was then subjected to granule formation by means of a fluid bed granulator (Fuji Paudal Co., "Grow Max FBG 230") by hydration of 15 kg water at an air flow rate of 1.2 m³/min. The granules were dried for 24 hours at 60° C and were subjected to sifting followed by gathering of about 70 kg of protein granules having a grain size of 10 to 50 mesh, a moisture content of 7%, and a bulk density of 0.58 g/cm³. Sixty kg of the protein granules were mixed with an equal quantity of activated charcoal granules having a grain size of 10 to 50 mesh, and a bulk density of 0.5 g/cm³ in order to obtain about 120 kg of composite granules having a grain size of 10 to 50 mesh and a bulk density of 0.54 g/cm³ with a V-shaped mixer. A cylinder of 102 mm in length and 24.3 mm in circumferential cross-section, which was made of polyethylene resin, was filled with 2 g of the composite granules, and 17 mm portions were placed in a tobacco pipe.

EXAMPLE 4

One kg of corn starch was added to 0.2 kg of egg white protein (Taiyo Chemical Industry Co., protein 80%, carbohydrate 5%, ash 6% fat 0.2%, moisture 8%) and blended by means of a screw mixer. The granule formation was performed in accordance with the procedure described in Example 2 and about 0.7 kg of the protein granules having a grain size of 10 to 50 mesh and a bulk density of 0.59 g/cm³ was gathered. One-half of the protein granules was then blended with an equal quantity of activated charcoal granules as described in Example 1 in order to obtain about 1 kg of composite granules having a grain size of 10 to 50 mesh and a bulk density of 0.56 g/cm³. A triple filter for cigarettes, in which the composite granules were placed in the central layer, was prepared in accordance with the procedure described in Experiment 1.

Typical properties of the protein granules prepared in accordance with the procedures described in Example 2 and those which were prepared for blending with the charcoal granules in Examples 1 and 3 are tabulated in Table 1.

TABLE 1
Properties of the protein granules

| | Example 1 | Example 2 | Example 3 |
|---|---|---|---|
| shape | pellet | pellet | spherical |
| bulk density (g/cm³) | 0.65 | 0.57 | 0.58 |
| average diameter (mm) | 1.33 | 1.36 | 1.12 |
| moisture content (%) | 6.3 | 6.1 | 5.8 |
| qualitative stability | no coloring, no odor generation, and no agglomeration were observed during 2 months storage at 30° C and the relative humidity of 85% | | |

Having now fully described the invention, it will be apparent to one of ordinary skill in the art that may changes nad modifications can be made thereto without departing from the spirit or scope of the invention as set forth herein.

What is claimed as new and intended to be secured by Letters Patent is:

1. A granular composition suitable for use in a tobacco filter and having an ability to selectively and effectively remove the carcinogenic and deleterious components from tobacco smoke comprising a blend of:

a. from 40 to 80%, by weight, of granules having a grain size of 10 to 50 mesh and a bulk density of 0.5 to 0.7 g/cm³ which are composed of 5 to 70%, by weight, of protein powder selected from the group consisting of bovine milk whey protein powder, egg white protein powder, and mixtures thereof, which is coated onto 30 to 95%, by weight, of excipient granules, and b. from 20 to 60%, by weight, of active charcoal granules having a grain size of 10 to 50 mesh and a bulk density of 0.5 to 0.7 g/cm³.

2. The composition of claim 1, wherein said excipient is selected from the group consisting of powdered cellulose, wheat flour, starch, rice flour, sugar, glucose, lactose, talc, alumina, zeolite, silica gel and mixtures thereof.

3. A tobacco filter whose active ingredients comprise the composition of claim 1.

4. A triple filter for cigarettes comprising a first and third layer of acetylcellulose and a second intervening layer of the composition of claim 1.

5. A filter cigarette having the filter of claim 3.

6. A method for reducing the carcinogenic and deleterious components in tobacco smoke which comprises passing the smoke through the filter of claim 5.

* * * * *